US008056378B2

(12) United States Patent
Huang et al.

(10) Patent No.: US 8,056,378 B2
(45) Date of Patent: Nov. 15, 2011

(54) REKEYABLE LOCK CYLINDER AND REKEYING METHOD THEREOF

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 482 days.

(21) Appl. No.: 12/289,483

(22) Filed: Oct. 29, 2008

(65) Prior Publication Data

US 2010/0101289 A1 Apr. 29, 2010

(51) Int. Cl.
*E05B 27/04* (2006.01)

(52) U.S. Cl. ..... 70/338; 70/340; 70/383; 70/384; 70/492; 70/493; 70/495

(58) Field of Classification Search ..... 70/382–385, 70/492, 493, 379 R, 356, 375, 387, 337, 338, 70/340
See application file for complete search history.

(56) References Cited

U.S. PATENT DOCUMENTS

| | | | | |
|---|---|---|---|---|
| 7,526,935 | B2 * | 5/2009 | Huang et al. | 70/360 |
| 7,624,606 | B1 * | 12/2009 | Huang et al. | 70/338 |
| 7,628,048 | B2 * | 12/2009 | Huang et al. | 70/338 |
| 7,836,739 | B2 * | 11/2010 | Huang et al. | 70/360 |
| 2008/0276674 | A1 * | 11/2008 | Huang et al. | 70/493 |
| 2009/0277240 | A1 * | 11/2009 | Huang et al. | 70/493 |

* cited by examiner

*Primary Examiner* — Suzanne Barrett
(74) *Attorney, Agent, or Firm* — Muncy, Geissler, Olds & Lowe, PLLC

(57) ABSTRACT

A rekeyable lock cylinder comprises a cylinder body, a plug, an adjusting block and a plurality of rack component assemblies. The plug disposed within the cylinder body has a trench and a plurality of rack component runners communicating with the trench. The adjusting block disposed at the trench has an arc sidewall, a plurality of leading slots corresponding to the rack component runners one by one and a position groove recessed from the arc sidewall. The position groove has a notch portion and a groove inner portion, wherein a depth of the groove inner portion is larger than a depth of the notch portion. Each of the rack component assemblies comprises a first rack component disposed at the rack component runner and a second rack component capable of engaging with the first rack component. Each of the first rack components has a rib portion located at the leading slot.

16 Claims, 14 Drawing Sheets

REKEYABLE LOCK CYLINDER AND REKEYING METHOD THEREOF

FIELD OF THE INVENTION

The present invention is generally relating to a lock cylinder, more particularly to a rekeyable lock cylinder and rekeying method thereof.

BACKGROUND OF THE INVENTION

Lock cylinder of known lock device typically is matched with a proper key so lock cylinder as well as key must be replaced in pair while replacing a lock, which results in high lock-replacing cost and inconvenience in use.

SUMMARY

The primary object of the present invention is to provide a rekeyable lock cylinder and rekeying method thereof. First, a first matched key is inserted into a plug and then turned to drive the plug and an adjusting block rotating. Next, a pulling force is added to the first matched key for driving the plug and the adjusting block to move and making a position pin to limit the adjusting block. Next, a thrust is added to the first matched key to make a plurality of first rack components be caught by the adjusting block and disengage with a plurality of second rack components. Next, the first matched key is turned to make the position pin position the adjusting block within a cylinder body and then pulled out before inserting a second matched key into the plug. Next, the second matched key is turned to make the adjusting block release from limitation of the position pin and drive the first rack components to reengage with the second rack components. Finally, the second matched key is pulled out to complete the entire rekeying process. Therefore according to the present invention, lock replacement can be completed as soon as rekeying another matched key only without replacing lock cylinder, which may provide advantages of widely reducing rekeying cost and increasing convenience in use.

A rekeyable lock cylinder in accordance with the present invention comprises a cylinder body, a plug, an adjusting block and a plurality of rack component assemblies. The cylinder body has a hollow cylinder portion. The plug, which is disposed within the hollow cylinder portion of the cylinder body, has a trench, a plurality of lower pin holes and a plurality of rack component runners communicating with the trench and the lower pin holes. The adjusting block, which is disposed within the trench of the plug, has an arc sidewall, a plurality of leading slots corresponding to the rack component runners and a position groove recessed from the arc sidewall. The position groove has a notch portion and a groove inner portion communicating with the notch portion, wherein a depth of the groove inner portion is larger than a depth of the notch portion. Each of the rack component assemblies comprises a first rack component disposed at the rack component runner of the plug and a second rack component capable of engaging with the first rack component, each of the first rack components has a rib portion located at the leading slot of the adjusting block.

Rekeying method of a rekeyable lock cylinder in accordance with the present invention comprises initially a step of providing a rekeyable lock cylinder. The rekeyable lock cylinder comprises at least a cylinder body, a position pin disposed within the cylinder body, a plug also disposed within the cylinder body, an adjusting block disposed at the plug and a plurality of rack component assemblies. Each of the rack component assemblies comprises a first rack component and a second rack component engaging with the first rack component. Next, the steps of inserting a first matched key into the plug, turning the first matched key, adding a pulling force to the first matched key for driving the plug and the adjusting block to move and making a position pin to limit the adjusting block, adding a thrust to the first matched key to make the first rack components be caught by the adjusting block and disengage with the second rack components, turning the first matched key to make the position pin to position the adjusting block within a cylinder body, pulling out the first matched key, inserting a second matched key into the plug and turning it to make the adjusting block release from limitation of the position pin and drive the first rack components to reengage with the second rack components are performed step by step.

DETAILED DESCRIPTION OF THE INVENTION

Figure 1:
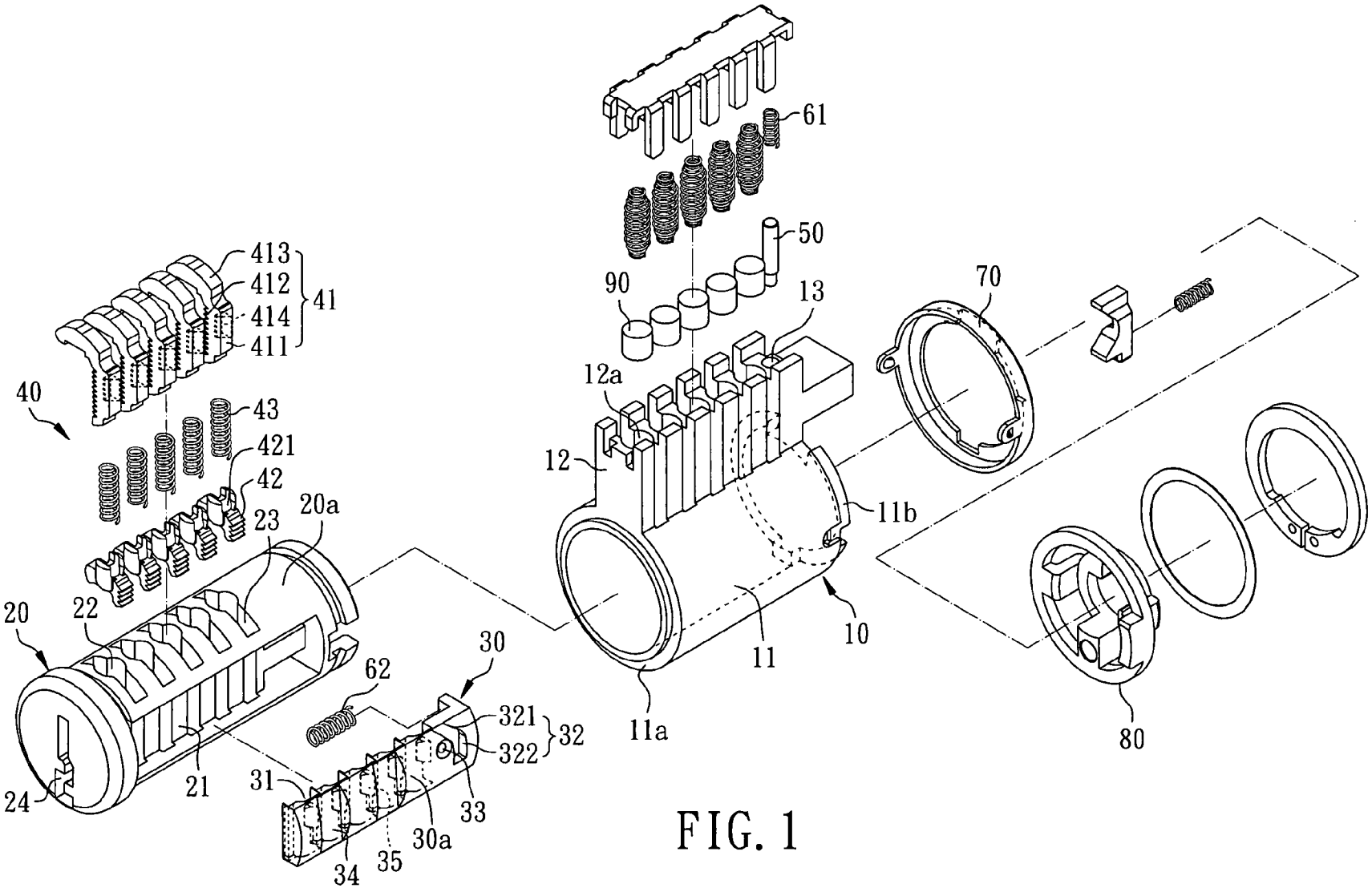
FIG. 1 is a perspective exploded view illustrating a rekeyable lock cylinder in accordance with a first preferred embodiment of the present invention.
Figure 2:
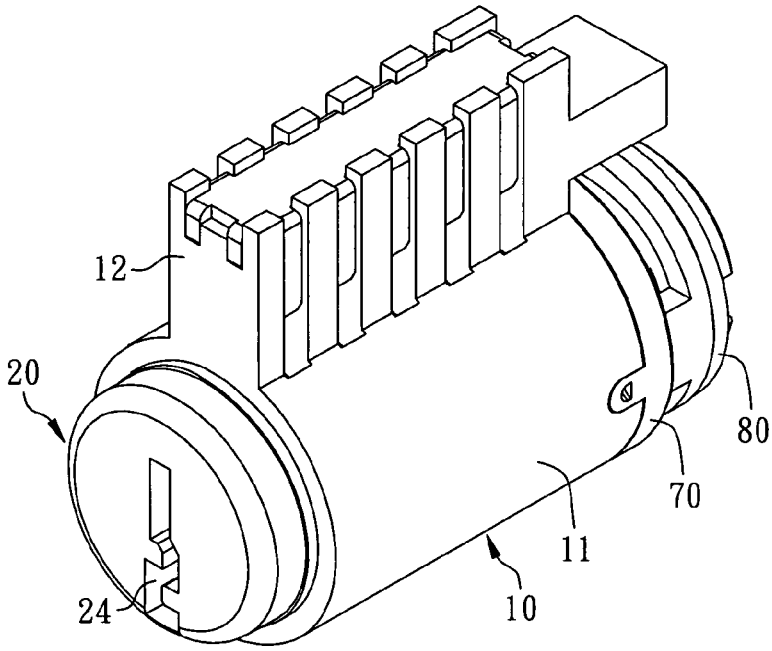
FIG. 2 is a perspective assembly view of the rekeyable lock cylinder.
Figure 3:
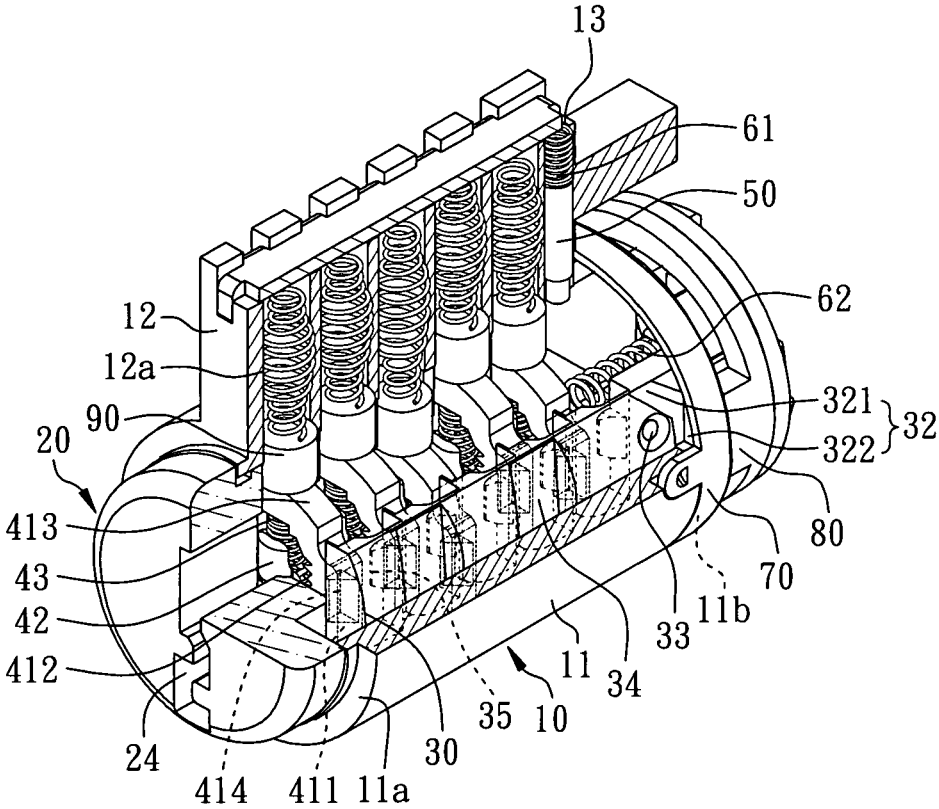
FIG. 3 is an assembly longitudinal section view of the rekeyable lock cylinder.
Figure 4:
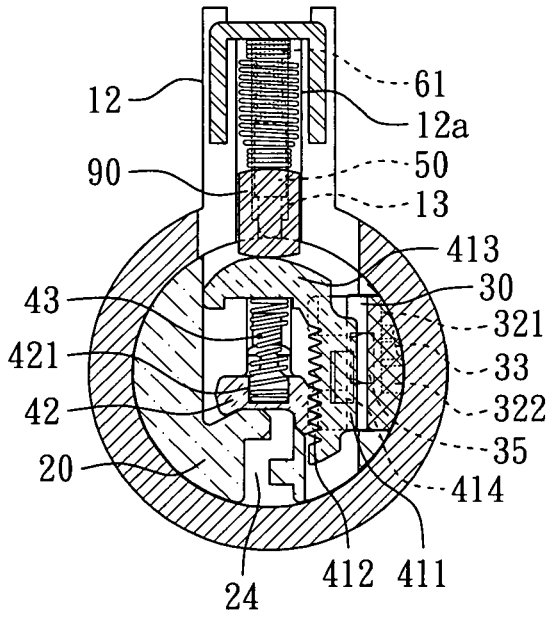
FIG. 4 is a partial section view of the rekeyable lock cylinder.

FIGS. 1 and 2 illustrates a rekeyable lock cylinder in accordance with a preferred embodiment of the present invention, which comprises a cylinder body 10, a plug 20, an adjusting block 30 and a plurality of rack component assemblies 40. The cylinder body 10 has a hollow cylinder portion 11, an extending protrusion 12 formed at one side of the hollow cylinder portion 11 and a through hole 13 formed at the extending protrusion 12. The hollow cylinder portion 11 has a first ending portion 11*a* and a second ending portion 11*b* relative to the first ending portion 11*a*, the extending protrusion 12 has a plurality of upper pin holes 12*a* for receiving a plurality of upper pins 90, and the through hole 13 communicates with the hollow cylinder portion 11 and is adjacent to the second ending portion 11*b* of the hollow cylinder portion 11. With reference to FIGS. 1, 3 and 4, the rekeyable lock cylinder further comprises a position pin 50, a first spring 61 for pushing the position pin 50 and an immovable ring 70 in this embodiment, the position pin 50 and the first spring 61 are disposed within the through hole 13 of the cylinder body 10, and the immovable ring 70 is disposed at the second ending portion 11*b* of the hollow cylinder portion 11.

Figure 5:
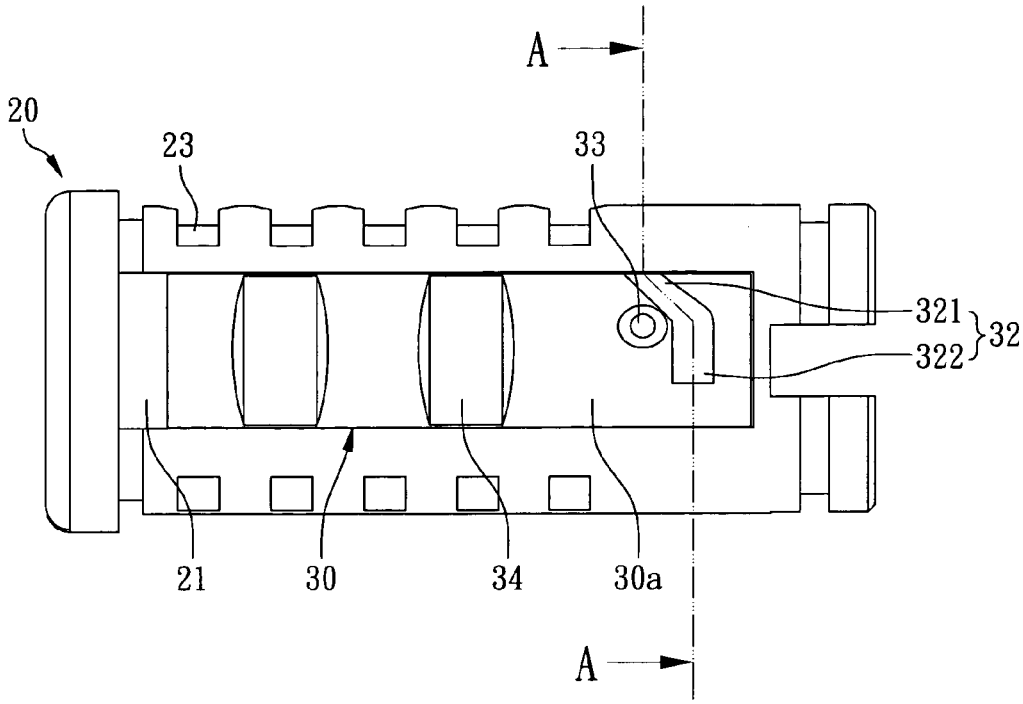
FIG. 5 is an assembly view of plug and adjusting block in accordance with a preferred embodiment of the present invention.
Figure 6:
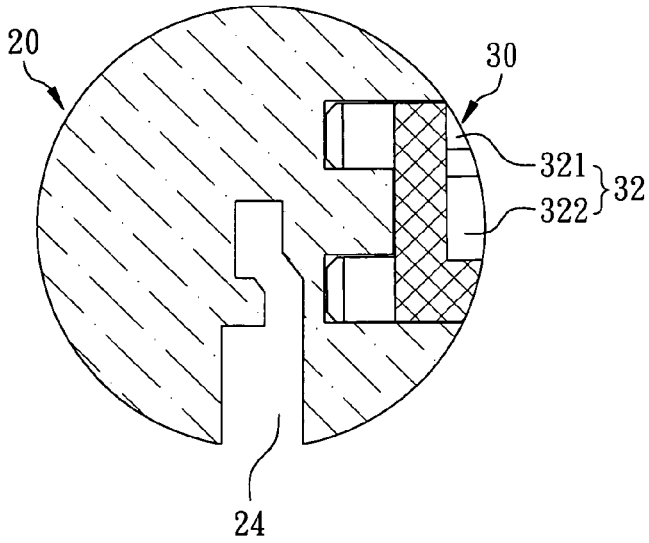
FIG. 6 is an assembly section view of plug and adjusting block along A-A line of FIG. 5.

With reference again to FIGS. 1, 3 and 4, the plug 20, which is disposed at the hollow cylinder portion 11 of the cylinder body 10, has an outside wall 20*a*, a trench 21 recessed from the outside wall 20*a*, a plurality of lower pin holes 22, a plurality of rack component runners 23 communicating with the trench 21 and the lower pin holes 22 and a keyhole 24 communicating with the lower pin holes 22. The adjusting block 30, which is disposed at the trench 21 of the plug 20, has an arc sidewall 30*a*, a plurality of leading slots 31 that each of them corresponds to each of the rack component runners 23, a position groove 32, a position hole 33 and at least a catching slot 34, wherein the position groove 32, the position hole 33 and the catching slot 34 are recessed from the arc sidewall 30*a* respectively. Besides, the adjusting block 30 has a plurality of skewed hook portions 35 respectively formed at one side of each of the leading slots 31, and the position groove 32 has a notch portion 321 and a groove inner portion 322 communicating with the notch portion 321. With reference to FIGS. 5 and 6, the notch portion 321 has a depth ranged from shallow to deep, and a depth of the groove inner portion 322 is larger than the depth of the notch portion 21. With reference to FIGS. 1, 3, 10 and 12, the position hole 33 is adjacent to the groove inner portion 322 of the position groove 32 and the position pin 50 may be selected to either fall into the position hole 33 or catch in the groove inner portion 322 of the position groove 32 in this embodiment. Besides, the catching slot 34 may selectively correspond to at least an upper pin 90 and limit it. The position hole 33 is located between the catching slot 34 and the groove inner portion 322 of the position groove 32. With reference again to FIGS. 1, 3 and 4, the rekeyable lock cylinder further comprises a second spring 62 and a drive member 80, wherein the second spring 62 is disposed at the trench 21 of the plug 20 and one end of the second spring 62 contacts against the adjusting block 30, the drive member 80 is jointed to one end of the plug 20.

Figure 14:
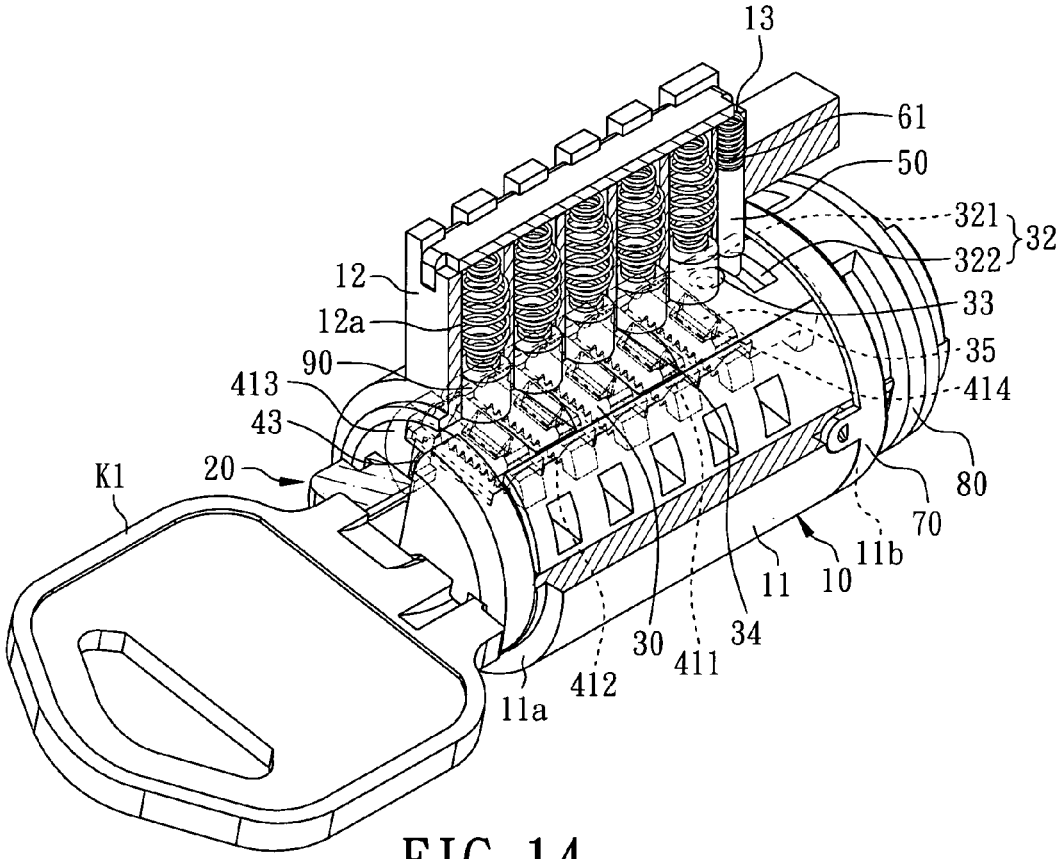
FIG. 14 is a partial section view of the rekeyable lock cylinder after adding a thrust to the first matched key in accordance with a preferred embodiment of the present invention.

With reference again to FIGS. 1, 3 and 4, each of the rack component assemblies 40 comprises a first rack component 41 disposed at the rack component runner 23 of the plug 20, a second rack component 42 capable of engaging with the first rack component 41 and a resilient member 43 disposed between the first rack component 41 and the second rack component 42. Each of the first rack components 41 has a rib portion 411 located at the leading slot 31 of the adjusting block 30, a rack portion 412 formed at the rib portion 411, an extending portion 413 connected with one end of the rib portion 411 and a chute 414 corresponding to the skewed hook portion 35 of the adjusting block 30. With reference to FIGS. 1, 3 and 14, it can be found in this embodiment that each of the chutes 414 is formed at the rib portion 411, each of the skewed hook portions 35 of the adjusting block 30 is capable of selectively catching in each of the chutes 414 of the first rack components 41, each of the second rack components 42 has a fixing recession 421 located at the lower pin hole 22 of the plug 20, two ends of each of the resilient members 43 respectively contact against the first rack component 41 and the second rack component 42 and preferably one end of each of the resilient members 43 is disposed at the fixing recession 421 of the second rack component 42.

Figure 7:
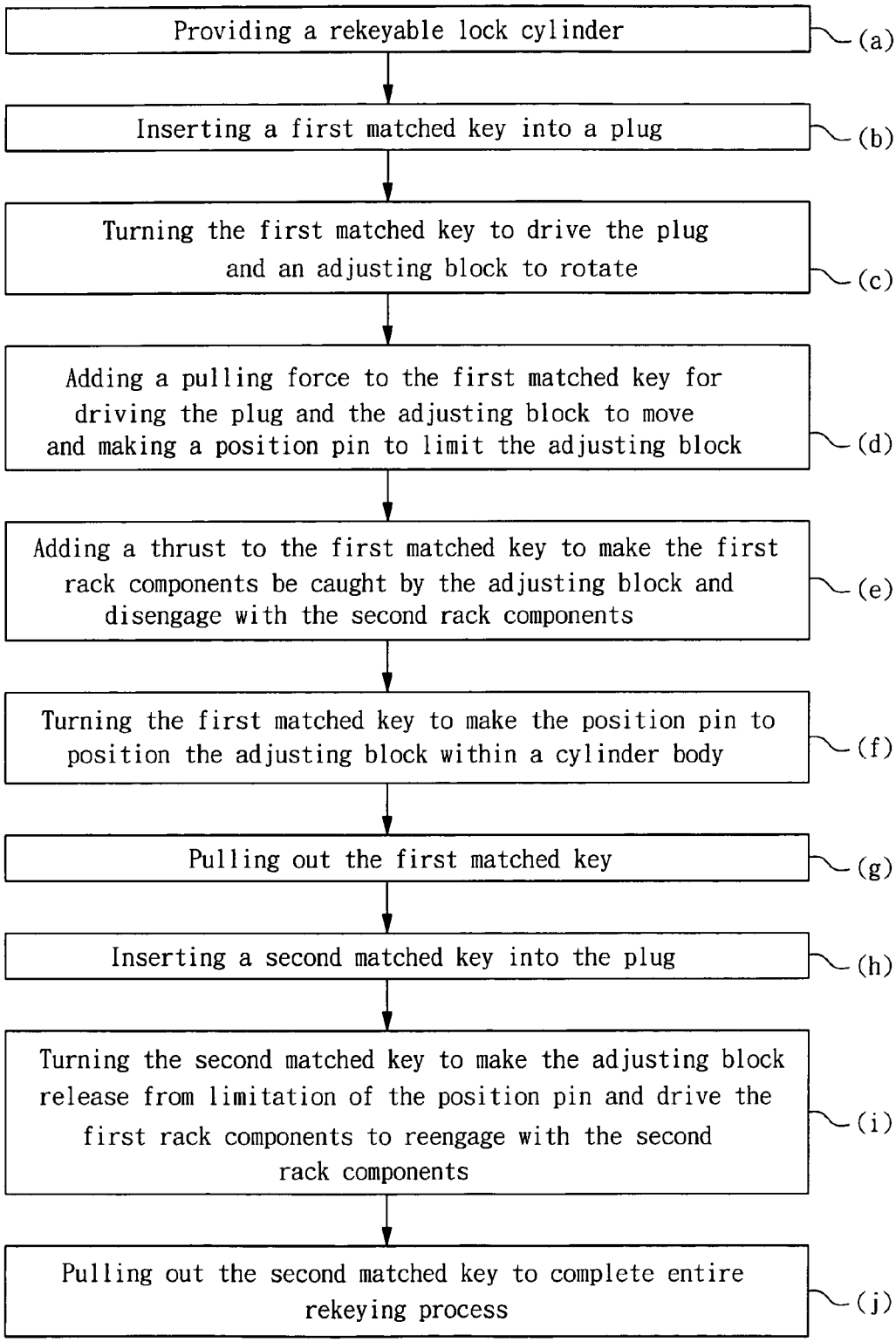
FIG. 7 is a flow chart illustrating rekeying method of the rekeyable lock cylinder.
Figure 8:
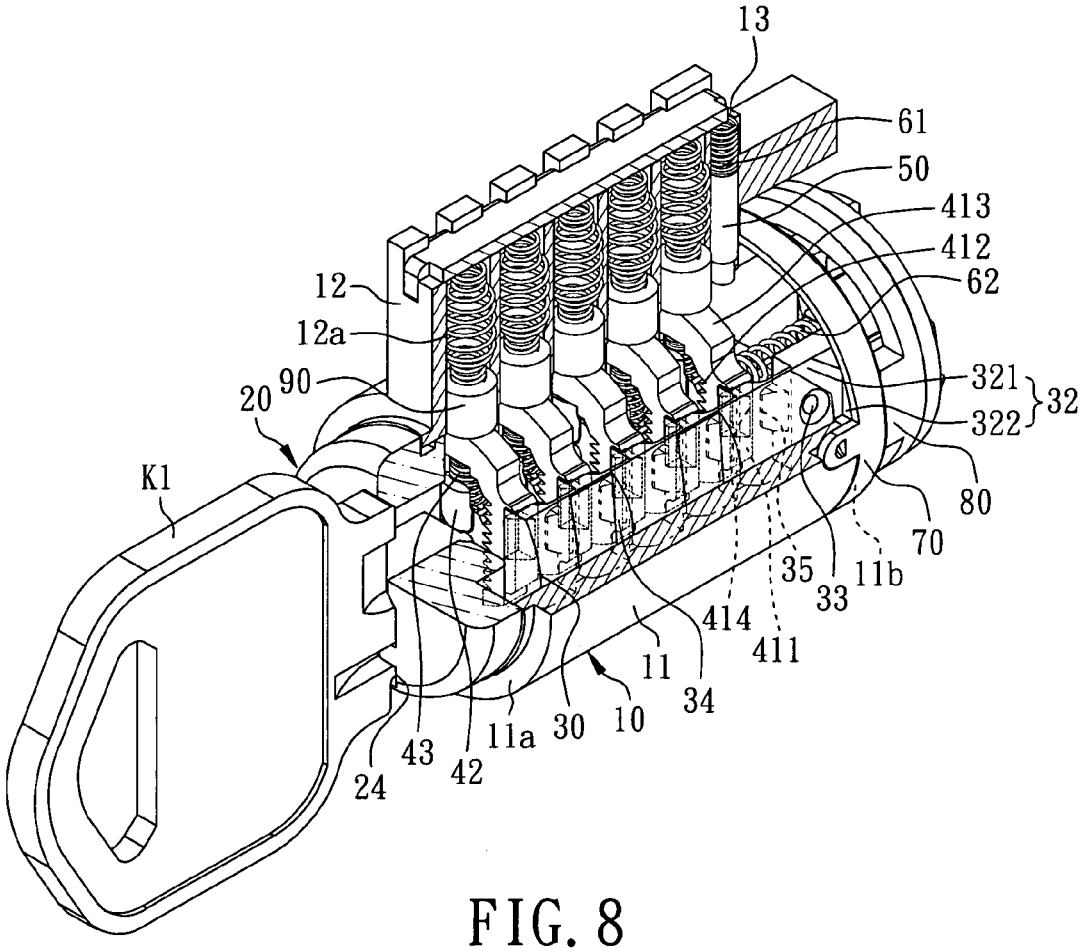
FIG. 8 is a partial section view of the rekeyable lock cylinder inserted with a first matched key in accordance with a preferred embodiment of the present invention.
Figure 9:
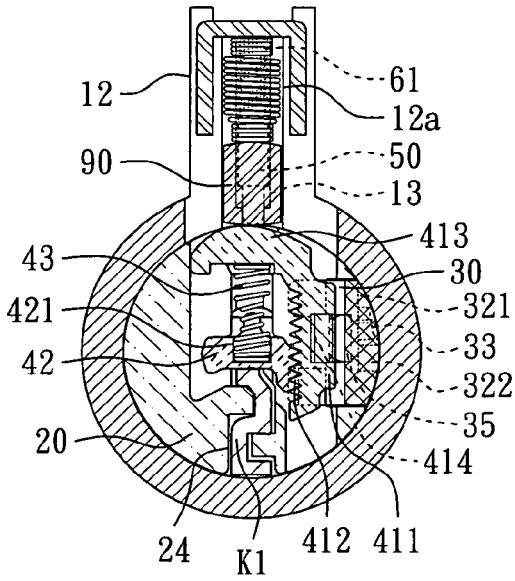
FIG. 9 is a longitudinal section view of the rekeyable lock cylinder inserted with a first matched key.
Figure 10:
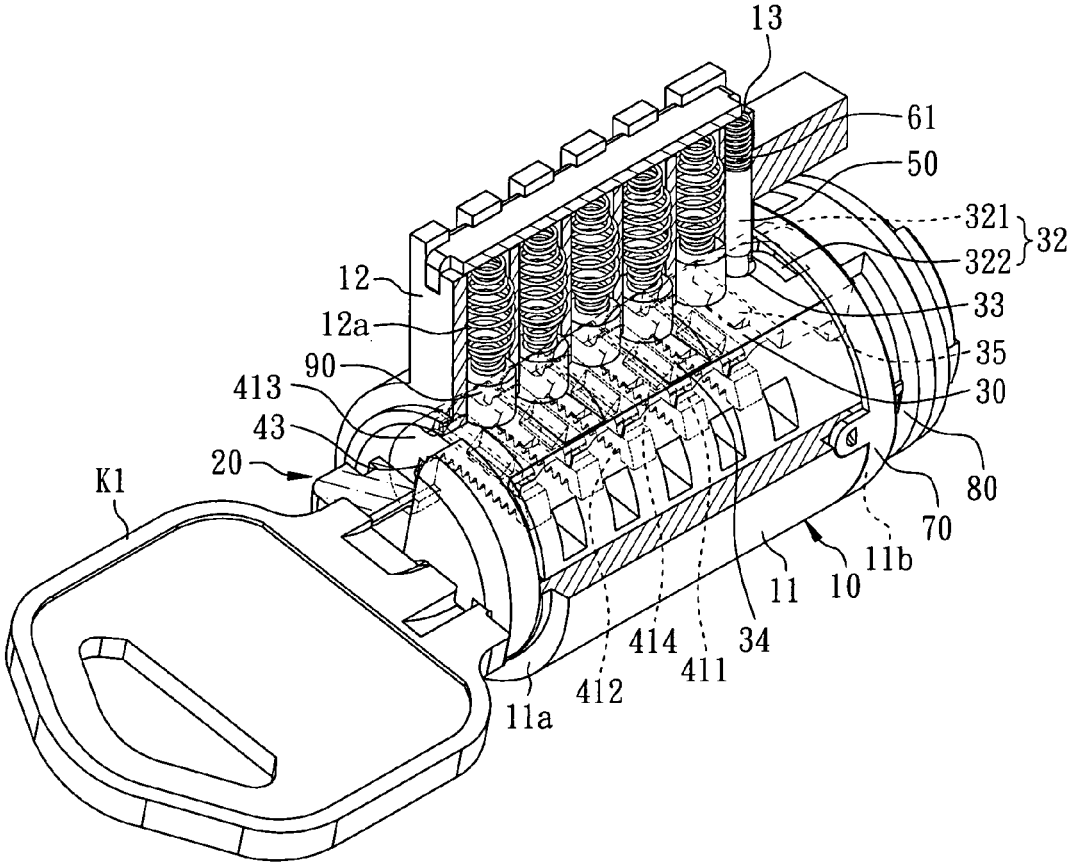
FIG. 10 is a partial section view of the rekeyable lock cylinder after turning the first matched key 80-degrees counterclockwise in accordance with a preferred embodiment of the present invention.
Figure 11:
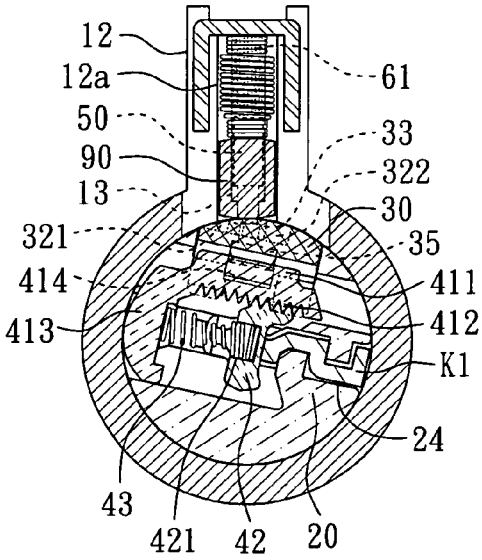
FIG. 11 is a longitudinal section view of the rekeyable lock cylinder after turning the first matched key 80-degrees counterclockwise.
Figure 12:
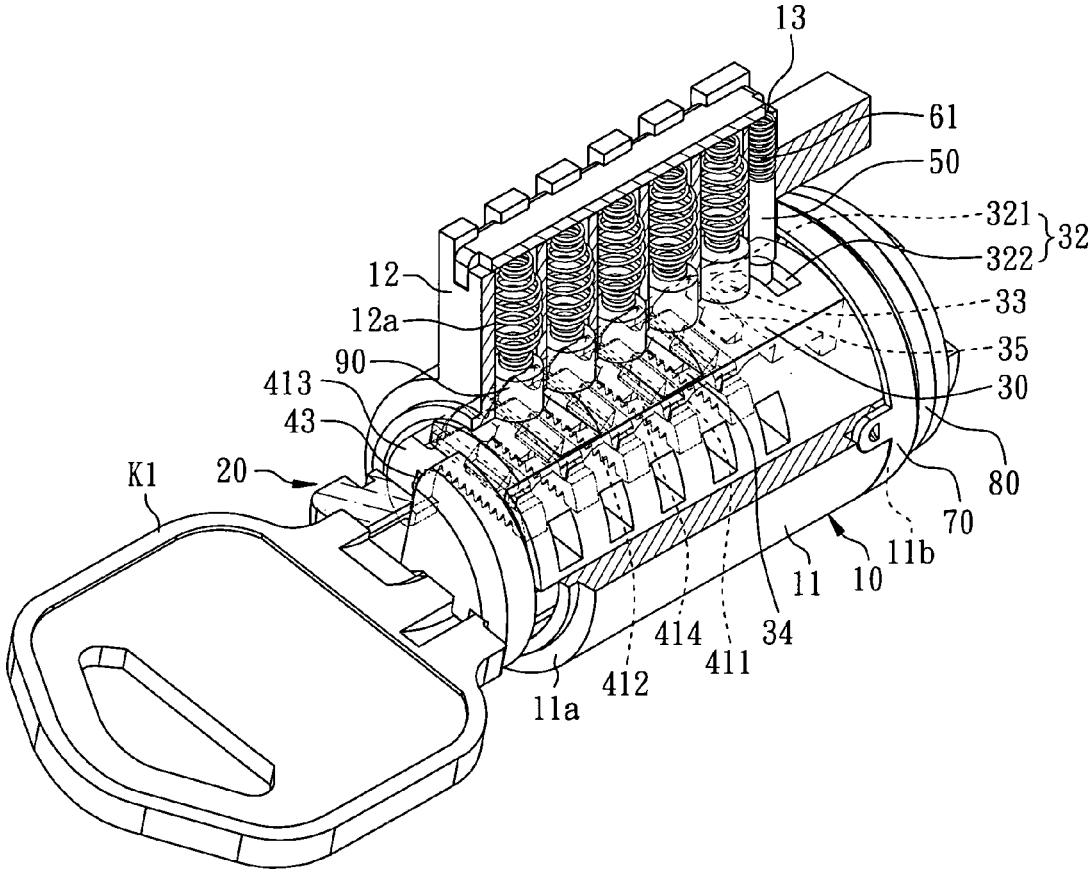
FIG. 12 is a partial section view of the rekeyable lock cylinder after adding a pulling force to the first matched key in accordance with a preferred embodiment of the present invention.
Figure 13:
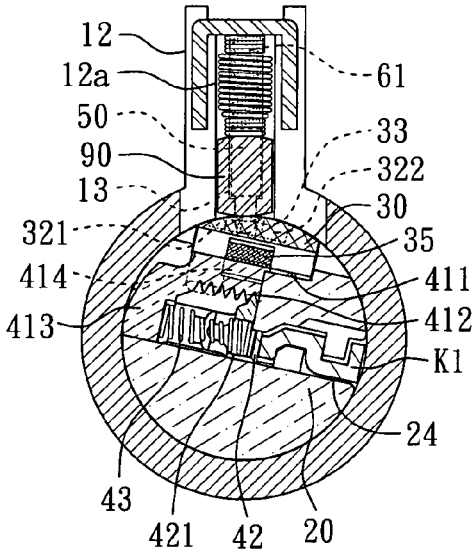
FIG. 13 is a longitudinal section view of the rekeyable lock cylinder after adding a pulling force to the first matched key.
Figure 15:
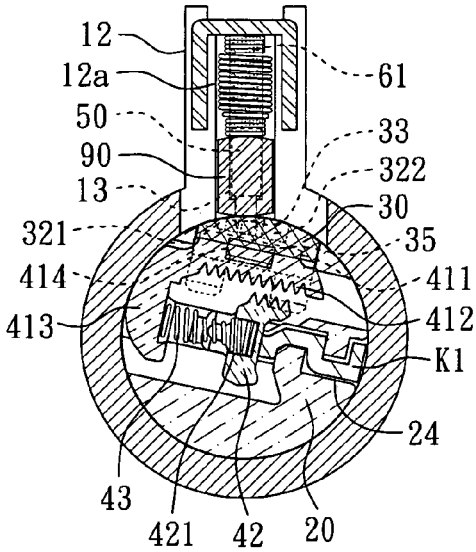
FIG. 15 is a longitudinal section view of the rekeyable lock cylinder after adding a thrust to the first matched key.
Figure 16:
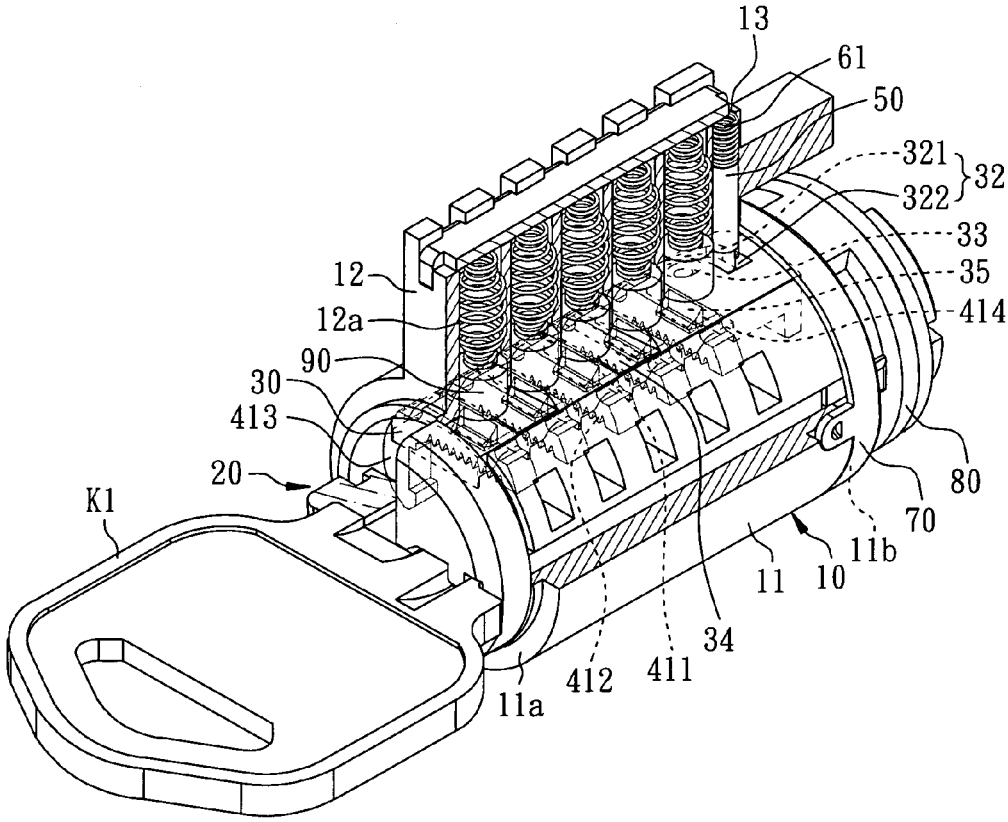
FIG. 16 is a partial section view of the rekeyable lock cylinder after turning the first matched key 10-degrees counterclockwise in accordance with a preferred embodiment of the present invention.
Figure 17:
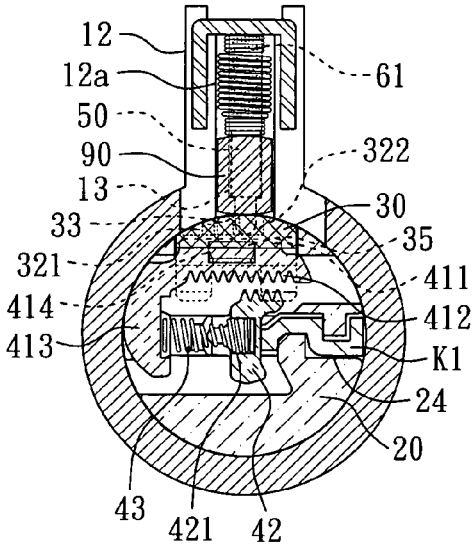
FIG. 17 is a longitudinal section view of the rekeyable lock cylinder after turning the first matched key 10-degrees counterclockwise.
Figure 18:
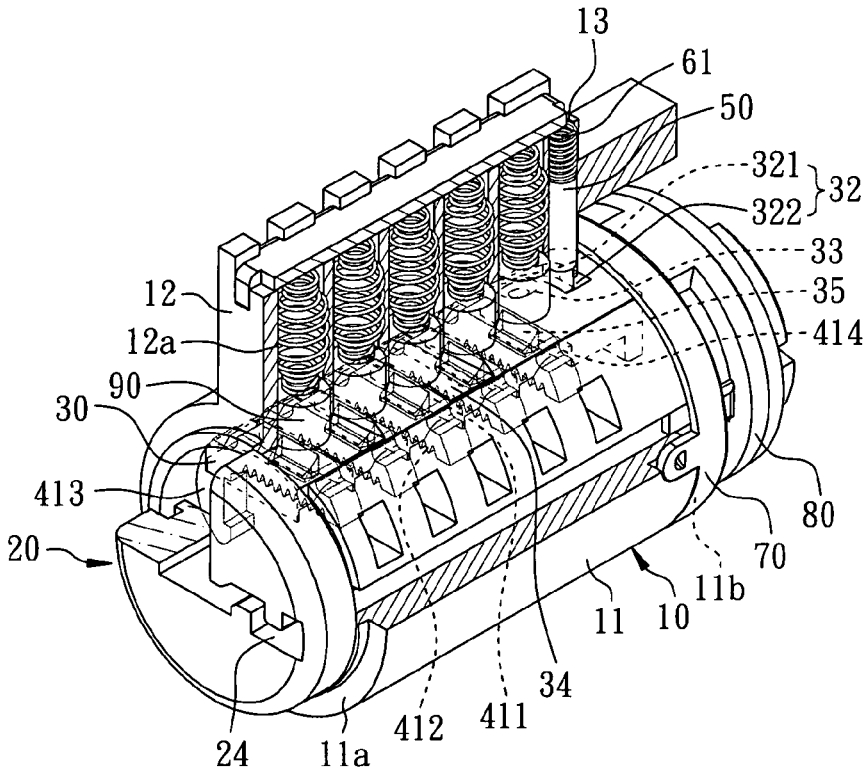
FIG. 18 is a partial section view of the rekeyable lock cylinder after pulling out the first matched key in accordance with a preferred embodiment of the present invention.
Figure 19:
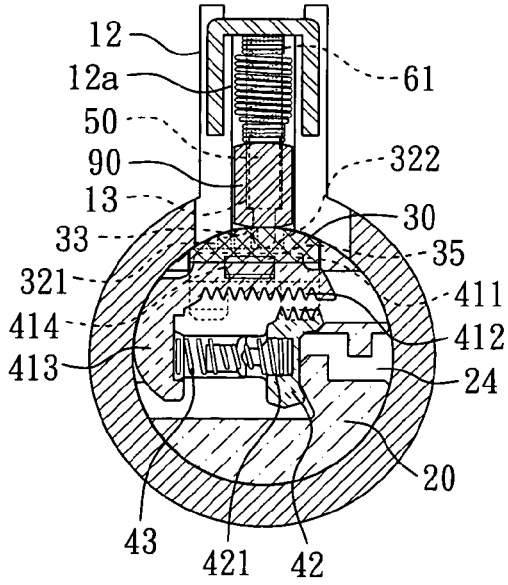
FIG. 19 is a longitudinal section view of the rekeyable lock cylinder after out the first matched key.
Figure 20:
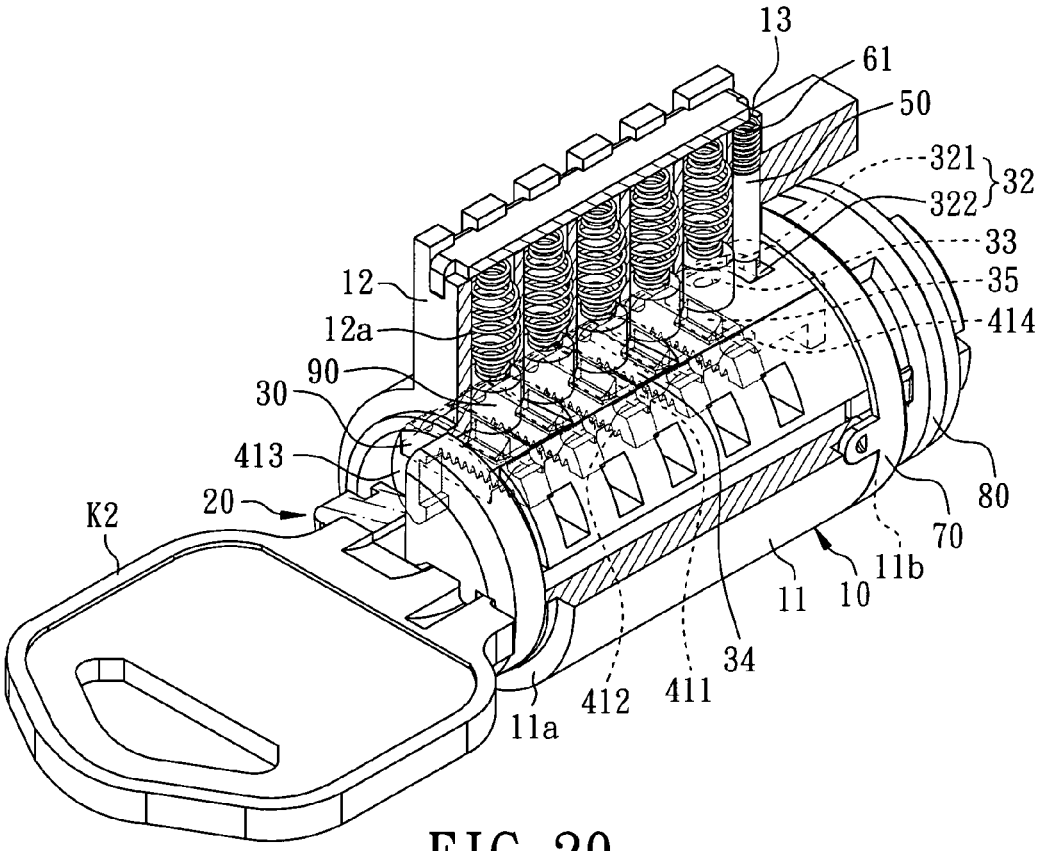
FIG. 20 is a partial section view of the rekeyable lock cylinder inserted with a second matched key in accordance with a preferred embodiment of the present invention.
Figure 21:
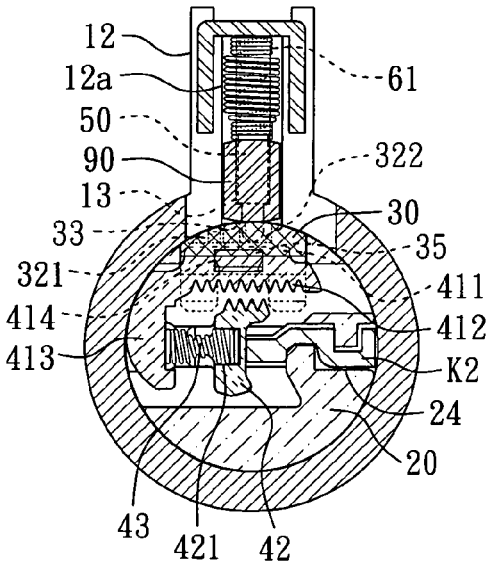
FIG. 21 is a longitudinal section view of the rekeyable lock cylinder inserted with a second matched key.
Figure 22:
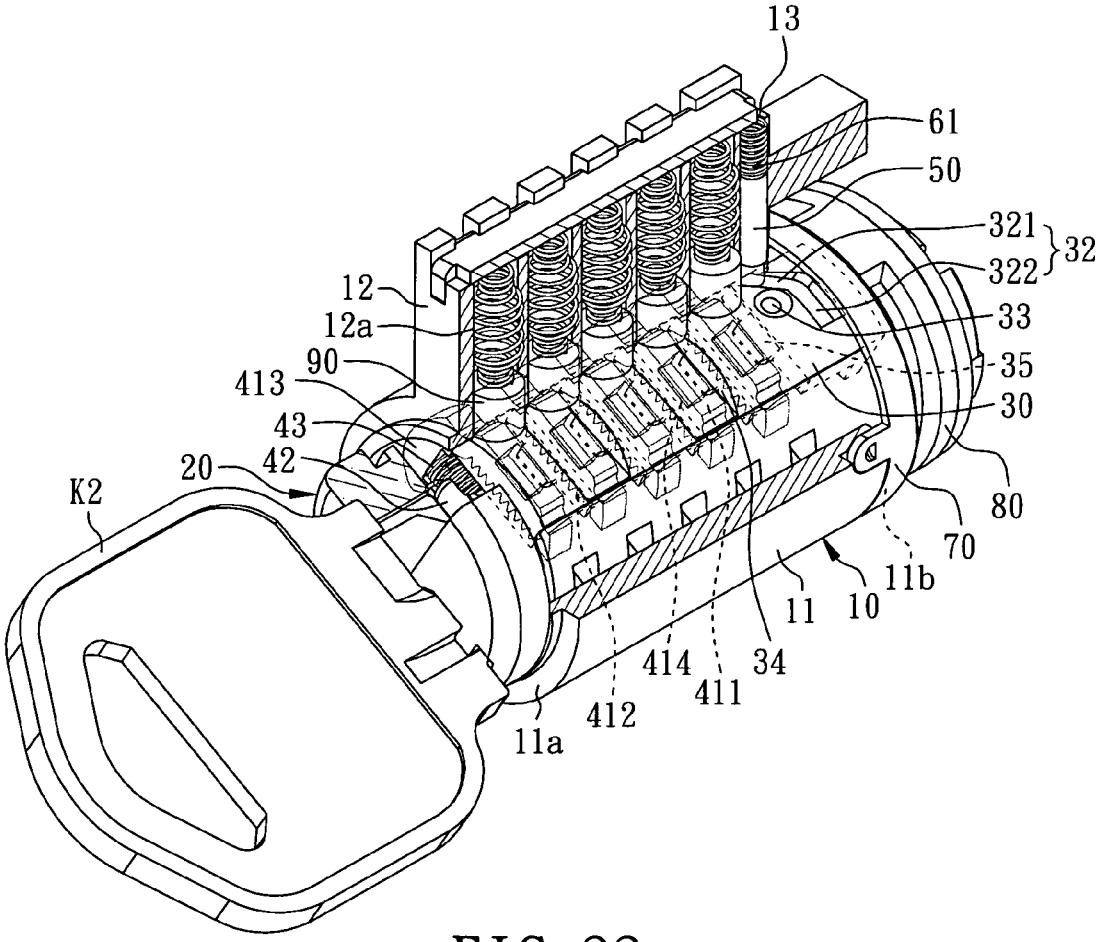
FIG. 22 is a partial section view of the rekeyable lock cylinder after turning the second matched key clockwise in accordance with a preferred embodiment of the present invention.
Figure 23:
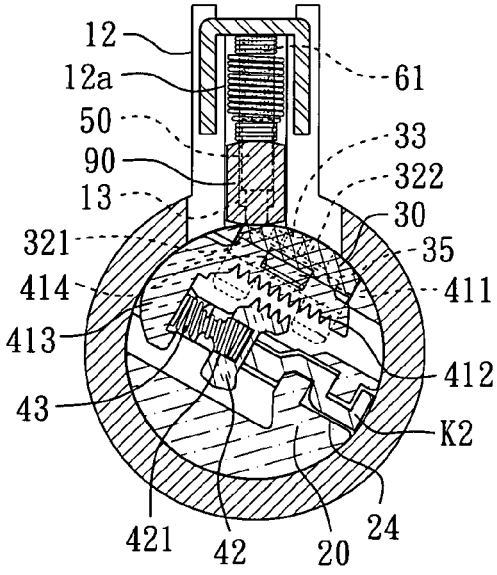
FIG. 23 is a longitudinal section view of the rekeyable lock cylinder after turning the second matched key clockwise.
Figure 24:
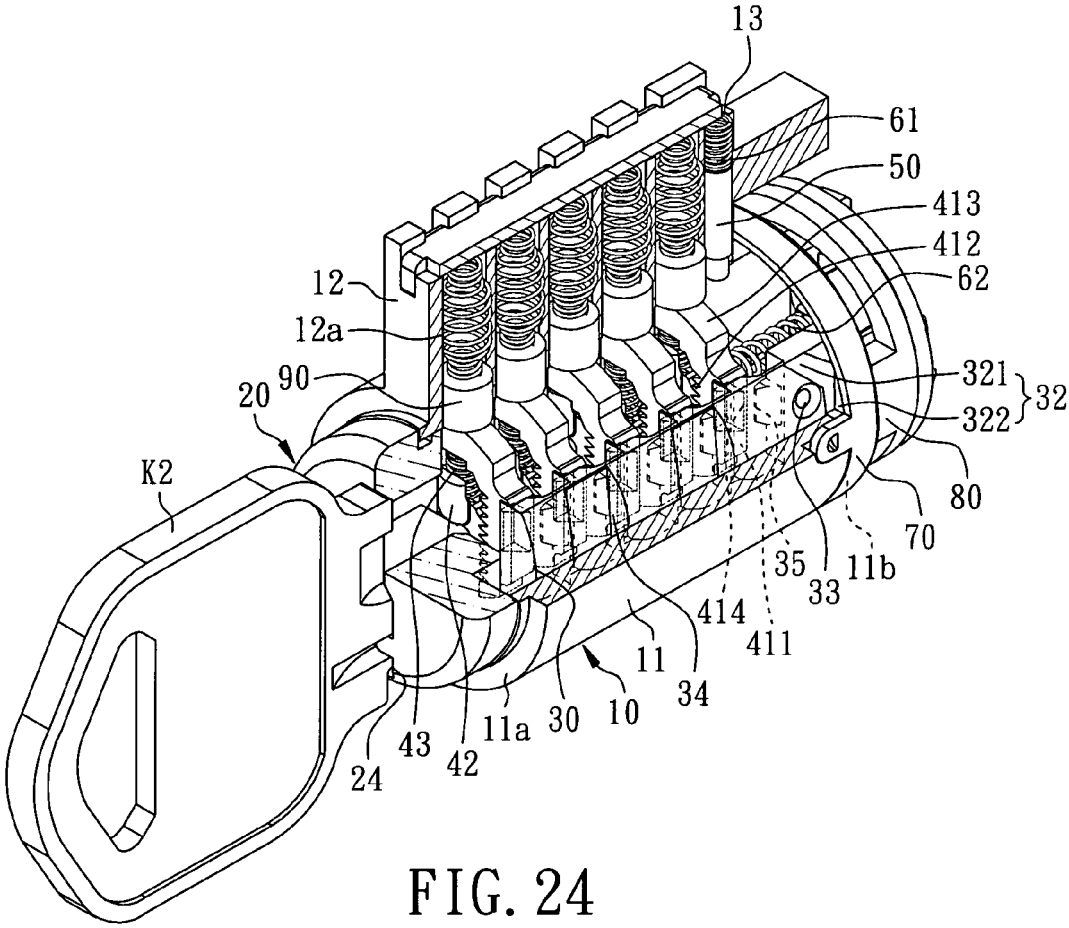
FIG. 24 is a partial section view of the rekeyable lock cylinder under a normal operating condition in accordance with a preferred embodiment of the present invention.
Figure 25:
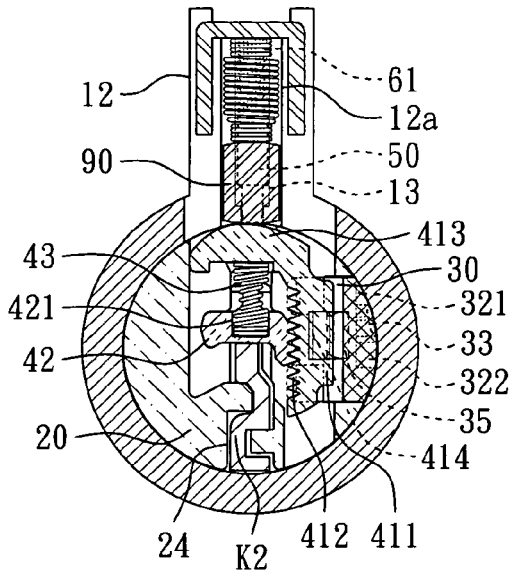
FIG. 25 is a longitudinal section view of the rekeyable lock cylinder under a normal operating condition.

FIG. 7 illustrates rekeying method of the rekeyable lock cylinder comprising "providing a rekeyable lock cylinder" step a, "inserting a first matched key into a plug" step b, "turning the first matched key to drive the plug and an adjusting block to rotate" step c, "adding a pulling force to the first matched key for driving the plug and the adjusting block to move and making a position pin to limit the adjusting block" step d, "adding a thrust to the first matched key to make the first rack components be caught by the adjusting block and disengage with the second rack components" step e, "turning the first matched key to make the position pin to position the adjusting block within a cylinder body" step f, "pulling out the first matched key" step g, "inserting a second matched key into the plug" step h, "turning the second matched key to make the adjusting block release from limitation of the position pin and drive the first rack components to reengage with second rack components" step i and "pulling out the second matched key to complete entire rekeying process" step j. First, with reference to FIGS. 2, 3, 4 and 7, "providing a rekeyable lock cylinder" step a is proceeded, in which the rekeyable lock cylinder is composed by assembling the cylinder body 10, the plug 20, the adjusting block 30 and the rack component assemblies 40, the first rack components 41 engage with the second rack components 42. Next, with reference to FIGS. 7, 8 and 9, "inserting a first matched key into a plug" step b is proceeded, in which a first matched key K1 is inserted into the keyhole 24 of the plug 20 and the first matched key K1 will push the rack component assemblies 40 to move upward to rotating interface in this embodiment. Next, with reference to FIGS. 7, 10 and 11, "turning the first matched key to drive the plug and an adjusting block to rotate" step c is proceeded, in which the first matched key K1 is turned to drive the plug 20 and the adjusting block 30 to rotate at a predetermined angular position and the first matched key K1 is turned by 80-degrees counterclockwise in this embodiment to make the position hole 33 of the adjusting block 30 correspond to the position pin 50, meantime the first spring 61 will push the position pin 50 to fall into and be caught in the position hole 33. It may also be found in this embodiment that the position pin 50 will position the plug 20, the adjusting block 30 and the rack component assemblies 40 by 80-degrees. Next, with reference to FIGS. 7, 12 and 13, "adding a pulling force to the first matched key for driving the plug and the adjusting block to move and making a position pin to limit the adjusting block" step d is proceeded, in which a pulling force is added to the first matched key K1 for driving the plug 20, the adjusting block 30 and the rack component assemblies 40 to move transversely relative to the cylinder body 10, meantime the position pin 50 will fall into the position groove 32 of the adjusting block 30 to limit the adjusting block 30. Next, with reference to FIGS. 7, 14 and 15, "adding a thrust to the first matched key to make the first rack components be caught by the adjusting block and disengage with the second rack components" step e is proceeded, in which a thrust is added to the first matched key K1 to make the plug 20 restore and drive the first rack components 41 to be caught by the adjusting block 30. In this embodiment, the adjusting block 30 cannot move due to limitation of the position pin 50 and the chutes 414 of the first rack components 41 will contact the skewed hook portions 35 of the adjusting block 30 during restoring process of the plug 20, so that the first rack components 41 are guided by the skewed hook portions 35 of the adjusting block 30 to move transversely into the leading slots 31 and meantime disengage with the second rack components 42. In addition, the skewed hook portion 35 of the adjusting block 30 will be completely caught in the chutes 414 of the first rack components 41 after restoration of the plug 20. Next, with reference to FIGS. 7, 16 and 17, "turning the first matched key to make the position pin to position the adjusting block within a cylinder body" step f is proceeded, in which the first matched key K1 is turned to allow the position pin 50 to be caught in the groove inner portion 322 of the position groove 32 of the adjusting block 30, thereby positioning the adjusting block 30 within the cylinder body 10. Wherein the first matched key K1 is turned by 10-degrees counterclockwise in this embodiment. Next, with reference to FIGS. 7, 18 and 19, "pulling out the first matched key" step g is proceeded, in which the first matched key K1 is pulled out and the second rack components 42 of the rack component assemblies 40 are pushed by the resilient members 43 to fall to lowermost position whenever the first matched key K1 is pulled out in this embodiment. Next, with reference to FIGS. 7, 20 and 21, "inserting a second matched key into the plug" step h is proceeded, in which a second matched key K2 is inserted into the keyhole 24 in the plug 20 and the second rack components 42 of the rack component assemblies 40 will readjust height to meet different height of bitting of the second matched key K2 in this embodiment. Next, with reference to FIGS. 7, 22 and 23, "turning the second matched key to make the adjusting block release from limitation of the position pin and drive the first rack components to reengage with the second rack components" step i is proceeded, in which the second matched key K2 is turned to allow the adjusting block 30 to release from limitation of the position pin 50, meantime the adjusting block 30 is pushed by the second spring 62 to restore and drive the first rack components 41 to reengage with the second rack components 42. Wherein the second matched key K2 is turned by 90-degrees clockwise in this embodiment. Besides, with reference to FIGS. 24 and 25, the rekeyable lock cylinder will restore to normal operating condition after turning the second matched key clockwise. Finally, with reference again to FIG. 7, "pulling out the second matched key to complete entire rekeying process" step j is proceeded, in which the second matched key K2 is pulled out to complete entire rekeying process.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A rekeyable lock cylinder comprising:

a cylinder body having a hollow cylinder portion;

a plug disposed within the hollow cylinder portion of the cylinder body and having an outside wall, a trench recessed from the outside wall, a plurality of lower pin holes and a plurality of rack component runners communicating with the trench and the lower pin holes;

an adjusting block disposed within the trench of the plug and having an arc sidewall, a plurality of leading slots corresponding to the rack component runners and a position groove recessed from the arc sidewall, the position groove has a notch portion and a groove inner portion communicating with the notch portion, wherein a depth of the groove inner portion is larger than a depth of the notch portion; and a plurality of rack component assemblies, each of them comprising a first rack component disposed at the rack component runner of the plug and a second rack component capable of engaging with the first rack component, wherein each of the first rack components has a rib portion located at the leading slot of the adjusting block.

2. The rekeyable lock cylinder in accordance with claim 1, further comprising a position pin and a first spring for pushing the position pin, wherein the cylinder body has a through hole communicating with the hollow cylinder portion, the position pin and the first spring are disposed within the through hole of the cylinder body.

3. The rekeyable lock cylinder in accordance with claim 2, wherein the cylinder body has an extending protrusion formed at one side of the hollow cylinder portion and the through hole is formed at the extending protrusion.

4. The rekeyable cylinder door lock in accordance with claim 2, wherein the position pin is capable of catching in the groove inner portion of the position groove of the adjusting block.

5. The rekeyable lock cylinder in accordance with claim 2, wherein the adjusting block further has a position hole recessed from the arc sidewall, the position hole is adjacent to the groove inner portion of the position groove.

6. The rekeyable lock cylinder in accordance with claim 5, wherein the position pin is capable of falling into the position hole of the adjusting block.

7. The rekeyable lock cylinder in accordance with claim 5, wherein the adjusting block further has a catching slot recessed from the arc sidewall, the position hole is located between the catching slot and the groove inner portion of the position groove.

8. The rekeyable lock cylinder in accordance with claim 1, wherein the depth of the notch portion of the position groove ranges from shallow to deep.

9. The rekeyable lock cylinder in accordance with claim 1, wherein the adjusting block has a plurality of skewed hook portions respectively formed at one side of each of the leading slots, each of the first rack components has a chute corresponding to the skewed hook portion of the adjusting block.

10. The rekeyable lock cylinder in accordance with claim 9, wherein each of the skewed hook portions of the adjusting block is capable of selectively catching in each of the chutes of the first rack components.

11. The rekeyable lock cylinder in accordance with claim 9, wherein each of the first rack components further has a rack portion formed at the rib portion and an extending portion connecting with one end of the rib portion, each of the chutes of the first rack components is formed at each of the rib portions.

12. The rekeyable lock cylinder in accordance with claim 1, wherein each of the rack component assemblies further comprises a resilient member and two ends of the resilient member contact against the first rack component and the second rack component respectively.

13. The rekeyable lock cylinder in accordance with claim 1, further comprising a second spring disposed within the trench of the plug, wherein one end of the second spring contacts against the adjusting block.

14. Rekeying method of a rekeyable lock cylinder comprising the steps of:

providing a rekeyable lock cylinder, wherein the rekeyable cylinder lock at least comprises a cylinder body, a position pin disposed within the cylinder body, a plug disposed within the cylinder body, an adjusting block disposed at the plug and a plurality of rack component assemblies, each of the rack component assemblies comprises a first rack component and a second rack component engaging with the first rack component;

inserting a first matched key into the plug;

turning the first matched key;

adding a pulling force to the first matched key for driving the plug and the adjusting block to move and making the position pin to limit the adjusting block;

adding a thrust to the first matched key to make first rack components be caught by the adjusting block and disengage with the second rack components;

turning the first matched key to make the position pin to position the adjusting block within the cylinder body;

pulling out the first matched key;

inserting a second matched key into the plug; and turning the second matched key to make the adjusting block release from limitation of the position pin and drive the first rack components to reengage with the second rack components.

15. The rekeying method in accordance with claim 14, wherein the adjusting block has a position groove and the position pin will fall into the position groove to limit the adjusting block within the step of adding a pulling force to the first matched key.

16. The rekeying method in accordance with claim 15, wherein the position pin is caught in the position groove of the adjusting block to position the adjusting block at the cylinder body within the step of turning the first matched key.

* * * * *